US008944810B2

(12) United States Patent
Herslow

(10) Patent No.: US 8,944,810 B2
(45) Date of Patent: Feb. 3, 2015

(54) METAL CARD

(75) Inventor: John H. Herslow, Scotch Plains, NJ (US)

(73) Assignee: Composecure, LLC, Somerset, NJ (US)

( * ) Notice: Subject to any disclaimer, the term of this patent is extended or adjusted under 35 U.S.C. 154(b) by 879 days.

(21) Appl. No.: 12/931,024

(22) Filed: Jan. 21, 2011

(65) Prior Publication Data

US 2011/0189620 A1 Aug. 4, 2011

Related U.S. Application Data

(60) Provisional application No. 61/337,289, filed on Feb. 2, 2010.

(51) Int. Cl.
*F24J 1/00* (2006.01)
*C21D 1/26* (2006.01)
*F27D 15/00* (2006.01)

(52) U.S. Cl.
CPC . *C21D 1/26* (2013.01); *F27D 15/00* (2013.01)
USPC ..... 432/225; 432/9

(58) Field of Classification Search
USPC ..... 432/9, 225
See application file for complete search history.

(56) References Cited

U.S. PATENT DOCUMENTS

| | | | | |
|---|---|---|---|---|
| 1,601,287 | A * | 9/1926 | Bertinetti | 101/401 |
| 2,123,612 | A * | 7/1938 | Obert | 432/225 |
| 5,173,133 | A * | 12/1992 | Morin et al. | 148/567 |
| 5,702,666 | A * | 12/1997 | Hatakeyama et al. | 264/544 |
| 2008/0274225 | A1 * | 11/2008 | Bharadwai et al. | 425/174.4 |
| 2009/0020523 | A1 * | 1/2009 | DeMichael et al. | 219/553 |
| 2009/0294543 | A1 * | 12/2009 | Varga et al. | 235/492 |

* cited by examiner

*Primary Examiner* — Kang Hu
*Assistant Examiner* — John Bargero
(74) *Attorney, Agent, or Firm* — Henry I. Schanzer, Esq.

(57) ABSTRACT

A method and apparatus for treating a selected region of a metal layer, used to form a metal card, by annealing the selected metal region so the selected region becomes soft and ductile, while the rest of the metal layer remains stiff. The softened, ductile, selected metal region can be embossed with reduced power and with reduced wear and tear on the embossing equipment. Alternatively, the annealed metal layer can undergo additional processing steps to form an assembly which can then be embossed. The method may include the use of a fixture for holding the metal layer, with the fixture having a window region for enabling heat to be applied to soften the region of the metal layer within the window region. The fixture includes apparatus for cooling the portion of the metal layer outside of the window region and for preventing the temperature of the metal layer outside the window region from rising above predetermined limits.

14 Claims, 7 Drawing Sheets

METAL CARD

This invention claims priority from provisional application Ser. No. 61/337,289 filed Feb. 2, 2010 for Metal Card whose contents are incorporated herein by reference.

BACKGROUND OF THE INVENTION

This invention relates to metal-containing instruments and/or cards and to methods of making the same.

For the most part, cards, such as transaction cards, are generally made from thermoplastic materials, such as polyvinyl chloride (PVC) and polyethylene terephthalate (PET). However, these transaction cards are susceptible to being damaged or destroyed if exposed to harsh environments. For example, transaction cards left exposed to moisture and sunlight may become warped, cracked and unusable. In addition, thermoplastic transaction cards may be easily bent or may be broken or cut, thereby damaging the transaction card and rendering it unusable.

Accordingly, it has been proposed to make a card or instrument which contains at least a layer of metal (referred to herein as a "metal card") to impart both strength and durability to the card and so it can withstand exposure to the elements, such as moisture or sunlight. These cards (or instruments) may have at least one layer of metal or be made entirely of metal and may include the security and other useful features of known plastic cards, e.g., a magnetic stripe, an embedded microchip, a signature panel, a holographic image, or any other feature normally contained on or within a transaction card or instrument.

The use and manufacture of metal transaction cards for the reasons stated above and for differentiating the source of the card (e.g., to impart special status) has been known for many years. Initially, these metal cards were generally made of aluminum and were embossed, though they did not include a magnetic stripe or a micro-chip or signature panel. Softer and lighter materials such as aluminum were used; but these metals typically have a problem of taking a permanent "set" when bent for any reason (e.g., due to being carried in a wallet or pocket) and do not have significant stiffness and spring back.

Recent developments include the making of metal cards using solid titanium (or of layers of titanium) with a magnetic stripe and/or embedded micro-chip and/or signature panel. However, titanium and most metals are relatively hard and stiff compared with plastic. Embossing a solid and very stiff material, presents a severe problem to standard financial card embossing equipment, as compared to a plastic.

A proposed solution to the problem is suggested in U.S. Pat. No. 7,494,057, The suggestion includes cutting out a pocket within the metal for enabling the embossing of a thinner cut out region. This is a costly step and still requires the embossing of a hard, although thinner, surface which may cause excessive wear and tear and breakdown of standard machines. Also, power requirements for embossing solid metal (other than aluminum, or metals which are soft like aluminum) are very high causing excessive wear and tear on standard machines.

These problems are overcome in the manufacture of "metal" cards which are treated and readied, in accordance with the invention, for subsequent embossment.

SUMMARY OF THE INVENTION

One aspect of the invention is directed to a method for treating (e.g., by heating, or fully annealing) a region of a solid metal so it becomes soft and ductile, whereby the softened, ductile, region can then be more easily embossed. This makes it easier on the embossing equipment and decreases the amount of power needed to perform, the embossing function.

Annealing, as used herein, refers to a heat treatment of the metal portion of a metal intended to form a metal card wherein the metal is altered, causing changes in the properties of the metal such as its strength and hardness. It is a process that produces conditions by heating to above the recrystallization temperature and maintaining a suitable temperature, and then cooling. Annealing is used to induce ductility, soften material, relieve internal stresses, and refine the structure by making it homogeneous, and improve cold working properties.

Thus in accordance with the invention a metal card may be formed by applying heat and annealing a selected region of a metal layer and then embossing the selected region with a selected pattern (e.g., personalization of the card). This process enables the card to be embossed with less power and less wear and tear on the embossing equipment.

Another aspect of the invention includes forming a layer overlying the embossed metal layer which is sufficiently thin and soft to conform to the underlying encompassing embossed pattern.

In accordance with another aspect of the invention, a metal card may be formed by applying heat and annealing a selected region of a metal layer, adding at least one overlying additional soft layer to the metal layer and then embossing the combination of the overlying layer and the underlying selected region of the metal layer with a selected pattern.

Another aspect of the invention includes a fixture for holding a metal layer or a metal card, with the fixture having a window region (an opening) for enabling heat and/or other suitable treatment to be applied to a metal layer within the window region to soften the region of the card within the window region. The softened region can then be more easily embossed. The fixture may include means for cooling the portion of the metal layer or card outside of the window region and/or preventing its temperature from rising above predetermined limits. The fixture thus ensures that only the region of the card to be embossed is "treated". The regions of the card which are not to be embossed are not subjected to the heat treatment, whereby these regions remain hard and stiff and not subjected to bending. That is, the area of the card outside the window region remains rigid, resisting deformation when subsequently handled, (e.g., placed in a wallet).

The fixture may be designed to handle a single card at a time or to handle an entire metal sheet which can subsequently be cut to produce many different cards.

BRIEF DESCRIPTION OF THE DRAWINGS

In the accompanying drawings, which are not drawn to scale, like reference characters denote like components.

DETAILED DESCRIPTION OF THE INVENTION

Figure 1:
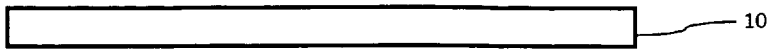
FIG. 1 is a cross sectional diagram of a metal layer for forming a card embodying the invention.

FIG. 1 shows a metal layer 10 which can be used to form a "metal" card embodying the invention. The layer 10 can be selected from any metal which can be treated (heated or "fully annealed") to a critical point where the metal becomes soft and ductile and retains that characteristic until further treated. Annealing as used herein refers to treating the metal so it can become soft and ductile and less brittle and can subsequently be molded or shaped without breaking. As discussed below, when the metal layer is in the soft ductile state it can be readily embossed.

The metal layer may be, for example, made of aluminum, copper, nickel, brass, steels including stainless steel, and/or precious metals, such as gold and silver. Basically, any metal can be used which can be softened with heat. As already noted, a requirement of metal layers, used to practice the invention, is that the metal layer be of the type which can be "treated" so it can be embossed without excessive wear and tear on the embossing equipment or the need for much power. In the cases of copper, steel, silver, and brass, the annealing process may be performed by substantially heating the material (generally until glowing) for a while and allowing it to cool. Unlike ferrous metals—which must be cooled slowly to anneal—copper, silver and brass can be cooled slowly in air or quickly by quenching in water. In this fashion the metal is softened and prepared for further work such as shaping, stamping, or forming.

Note that special machines and embossing dies may be required to emboss the card/instrument with permanent, personalized or other data/information on the card. A purpose of embossing is to imprint selected information on the card. This includes, but is not limited to, a card holder's name, account number, expiration date, etc on a card so it can be permanently imprinted.

Figure 2:
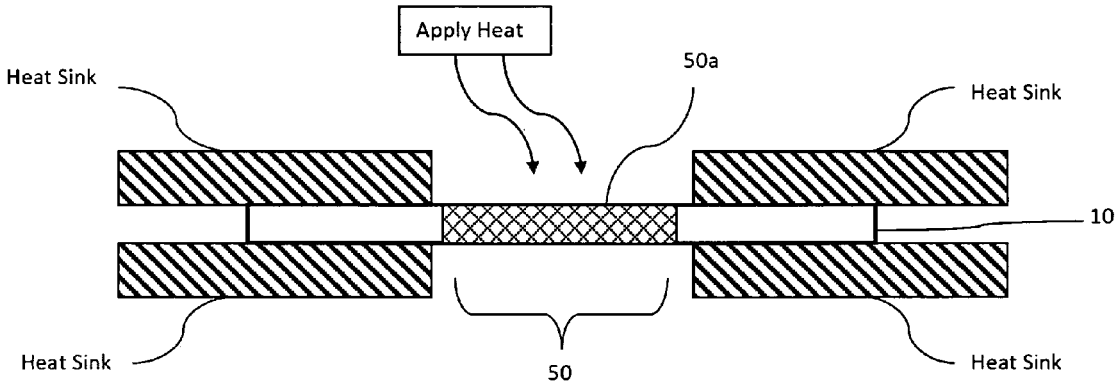
FIG. 2 is a simplified cross sectional diagram of a metal layer for forming a card embodying the invention with a heat sink attached to the front and back of the metal layer and illustrating the application of heat to treat (anneal) the region of the card within a window formed in the heat sink (e.g., a fixture) holding the card.

FIG. 2 shows the positioning of idealized heat sinks (e.g., cooled metal plates) to the back (above) and front (below) of the metal layer 10, leaving a "window" region 50 to which heat/treatment (annealing) can be applied to cause the area of the metal layer within the window region 50 to undergo the required change and become soft and ductile. The metal region 50*a* will remain soft and ductile. By making the area 50*a* of the metal layer corresponding to window region 50 soft and ductile enables the area 50*a* to be embossed without the force and difficulty found in the prior art.

Figure 3:
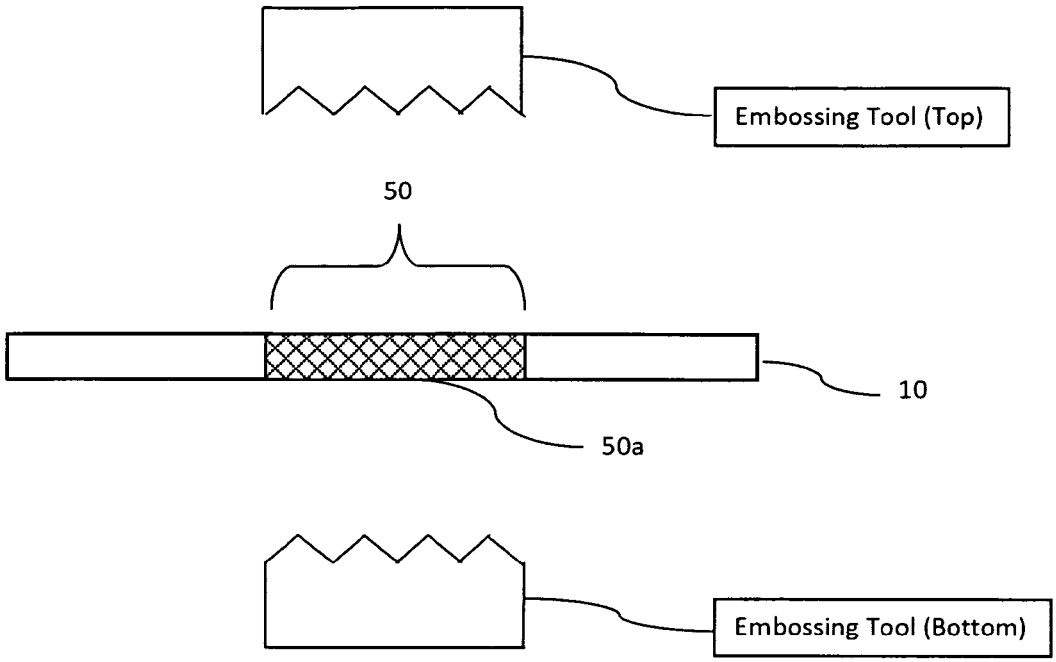
FIG. 3 is an idealized cross sectional diagram of an embossing tool applied to a treated (e.g., by heating, or fully annealing) region of a metal layer for embossing a card which has been "treated" in accordance with the invention. Embossing may be done by a personalizer in a special machine such as a Data Card 9000.

FIG. 3 illustrates that after the heat treatment the window region 50 of the metal layer 10 can then be embossed with an appropriate embossing tool (or machine). The embossing process can be performed at a different site and by a different entity than the entity which performs the "heat" treatment on the metal. In fact, as noted above, embossing may be done by a personalizer in a special machine such as a Data Card 9000.

Figure 4:
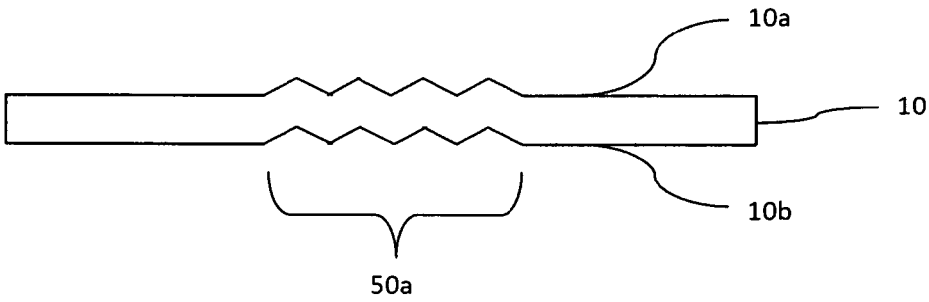
FIG. 4 is a simplified cross sectional diagram of a metal layer embossed in accordance with the invention.
Figure 4A:
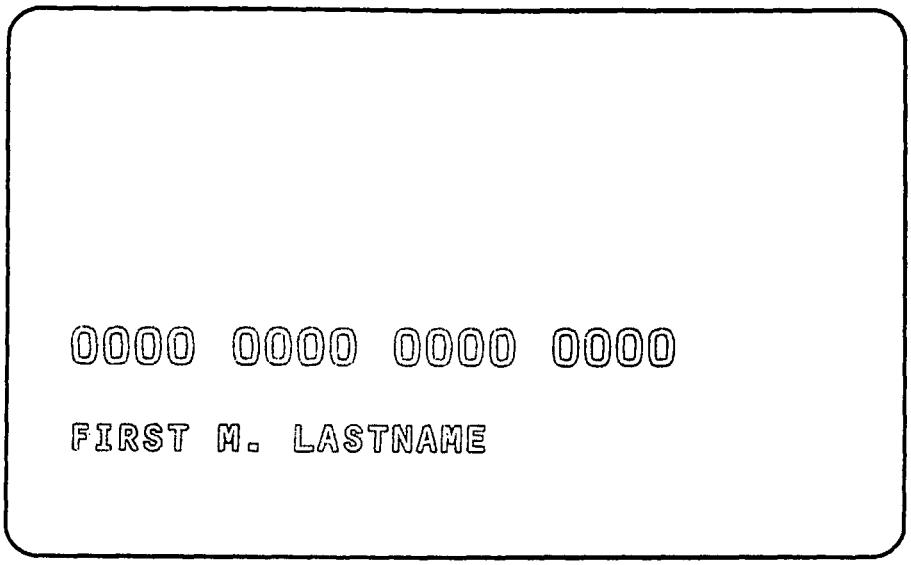
FIGS. 4A and 4B are top views of a metal card embodying the invention showing the presence of raised characters after the embossing step.
Figure 4B:
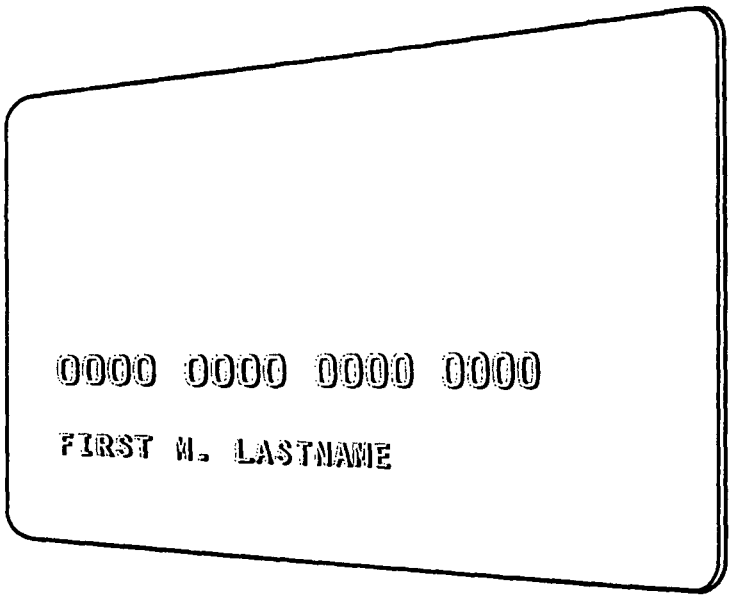

FIG. 4 shows an idealized cross section of a metal layer 10 whose region 50*a* was treated (annealed) in accordance with the invention and then embossed to produce the desired result. The metal layer 10, embossed, as shown in FIG. 4 may be used as is, as a metal card. In this instance, the metal layer 10 may be up to the full thickness of a standard transaction card.

In any event, the embossed metal layer 10 of FIG. 4 can be further processed to include features typically associated with transaction cards.

Figure 5:
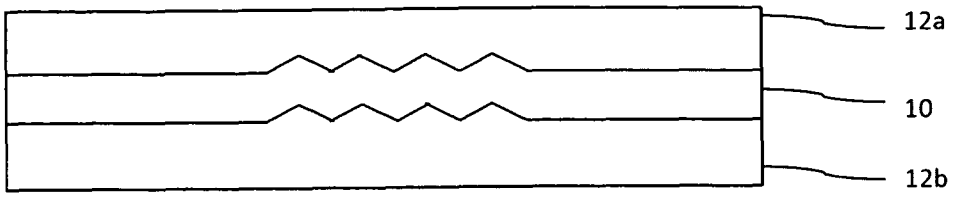
FIG. 5 is a simplified cross sectional diagram illustrating the addition of thin soft layers to the top and bottom surfaces of a metal layer after being treated and embossed as shown in FIGS. 2, 3 and 4.

FIG. 5 shows in cross section that a layer 12*b* can be formed below surface 10*b* of layer 10, as shown in the figure. Layer 12*b* would be a thin soft layer which can conform to the shape of the embossed region 50*a*. FIG. 5 also shows that a layer 12*a* (or several different layers) of any selected material may be formed along and above (in the figure) the surface 10*a* of layer 10.

Figure 6A:
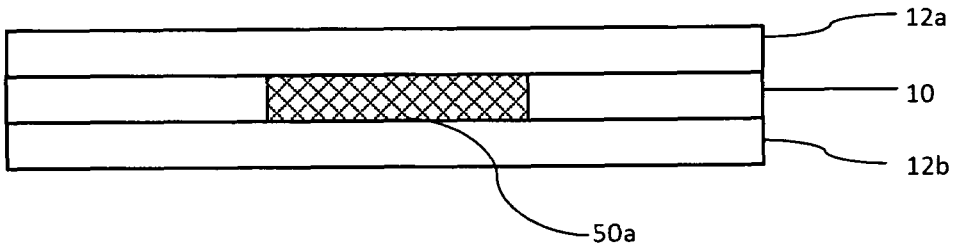
FIG. 6A is a simplified cross sectional diagram of a metal layer "treated" in accordance with the invention showing the addition of layers of soft material to its top and bottom surfaces prior to the combination being embossed.
Figure 6B:
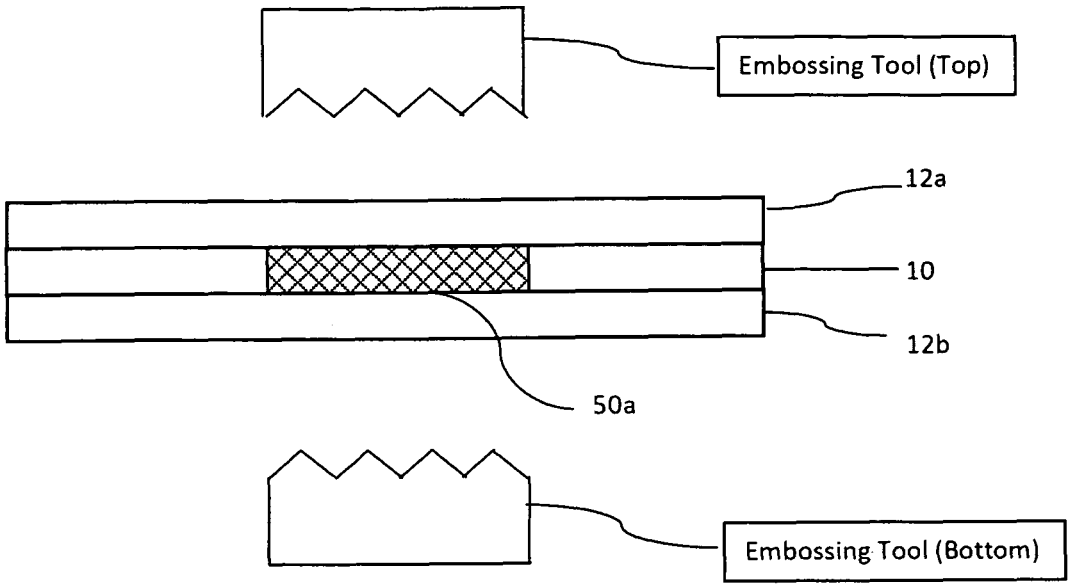
FIG. 6B is a simplified cross sectional diagram illustrating the application of an embossing tool to the (top and bottom) structure of FIG. 6A.
Figure 6C:
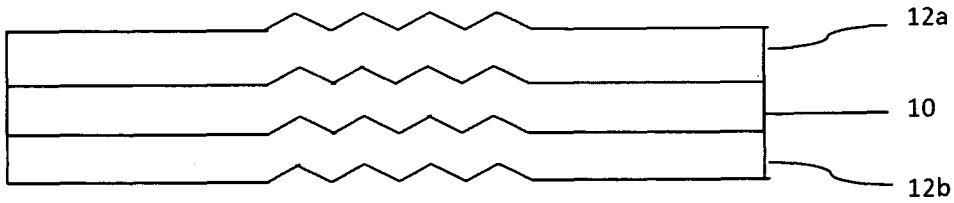
FIG. 6C is a simplified cross sectional diagram illustrating the resultant embossed pattern on the top and bottom of the "metal" card.

FIGS. 6A, 6B and 6C show a number of steps in a method of making a metal card in accordance with the invention. First, a metal layer 10 is "heat" treated so that an area 50*a* is annealed and rendered ductile as shown in FIG. 2. Then an additional layer 12*a* may be attached to the top surface (e.g., 10*a* as shown in FIG. 6A) of layer 10 and another additional layer 12*b* may be attached to the bottom surface (e.g., 10*b*) of layer 10, to form a three layered assembly as shown in FIG. 6A. The combined layers (10, 12*a* and 12*b*) may then be embossed with a desired pattern by an embossing tool, as shown in FIG. 6B. The embossing tool may have two sections (e.g., top and bottom in FIG. 6B) which cooperate to emboss the desired pattern onto the assembly. The resultant assembly would have an embossed metal layer 10 with an overlying coating (e.g., 12*a*) and underlying coating (e.g., 12*b*) imprinted with the same pattern embossed in the metal layer, as shown in FIG. 6C. During this step, or subsequently thereto, additional layers and additional processing steps may be added to the embossed metal layer and to the three-layered assembly.

Figure 7:
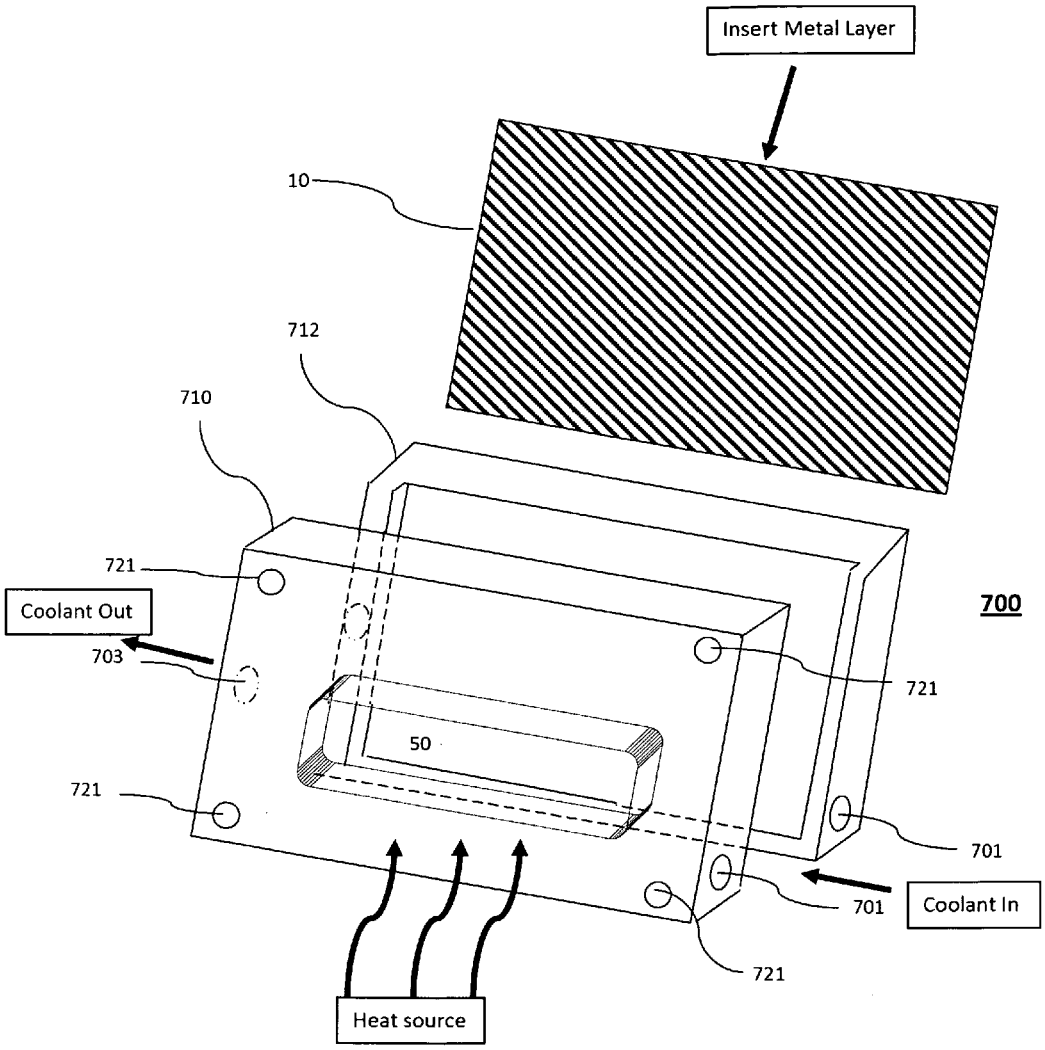
FIG. 7 is a simplified isometric drawing of an apparatus for enabling the holding of a metal layer (card or instrument) and having a "window" for the application of heat to the metal layer within the window region and blocking the application of the heat treatment to the regions of the metal layer outside the window.

The heat sinks shown in FIG. 2 may be part of a fixture (jig) 700 shown in FIG. 7. The fixture 700 includes at least two meshing plates 710, 712 between which a metal layer/card 10 can be securely nested. The plates 710, 712 when joined together include a relief space, or slot, in which the metal card 10 can be inserted and which can securely hold the metal layer/card 10. The fixture has a window region 50 for enabling the heat from a heat source, which may be a high energy heat source, to be applied to a corresponding selected region/area 50*a* of any metal (or substance) located within the window region of the fixture. The fixture 700 has a portion surrounding the window region 50 for maintaining the temperature of the portion of the metal layer 10 surrounding the region 50*a* at a temperature which will prevent the corresponding portion of metal layer 10 from becoming affected (e.g., soft) by the heat/annealing treatment imparted to region

50*a*. Note that fixture 700 is formed with a recess to accept a metal layer/card 10. Furthermore, the fixture functions as a template and is designed such that the window 50 lines up with the area of the metal layer/card 10 which has been selected to be embossed. Care is given to ensure that there is proper alignment so that the embossing step will occur in the desired area/portion of the metal card. In FIG. 7 cold water (or any other coolant) is inputted at inputs 701*a*, and circulated through the fixture. The warmed coolant exits at an output (or outputs) 703 to be sent to a refrigeration unit (not shown) before being pumped back (not shown) to the inputs. It should be appreciated that fixture 700 has many desirable features; however, any other suitable fixture may be used to perform this step.

Note that after region 50*a* of metal layer 10 has been embossed the metal layer 10 can be further treated to finalize the formation of a card. The further treatment may include plating, forming a magnetic stripe, laser printing, hot stamping, smart chip insertion, coating, embossing, indent printing, etc. . . . .

Figure 8:
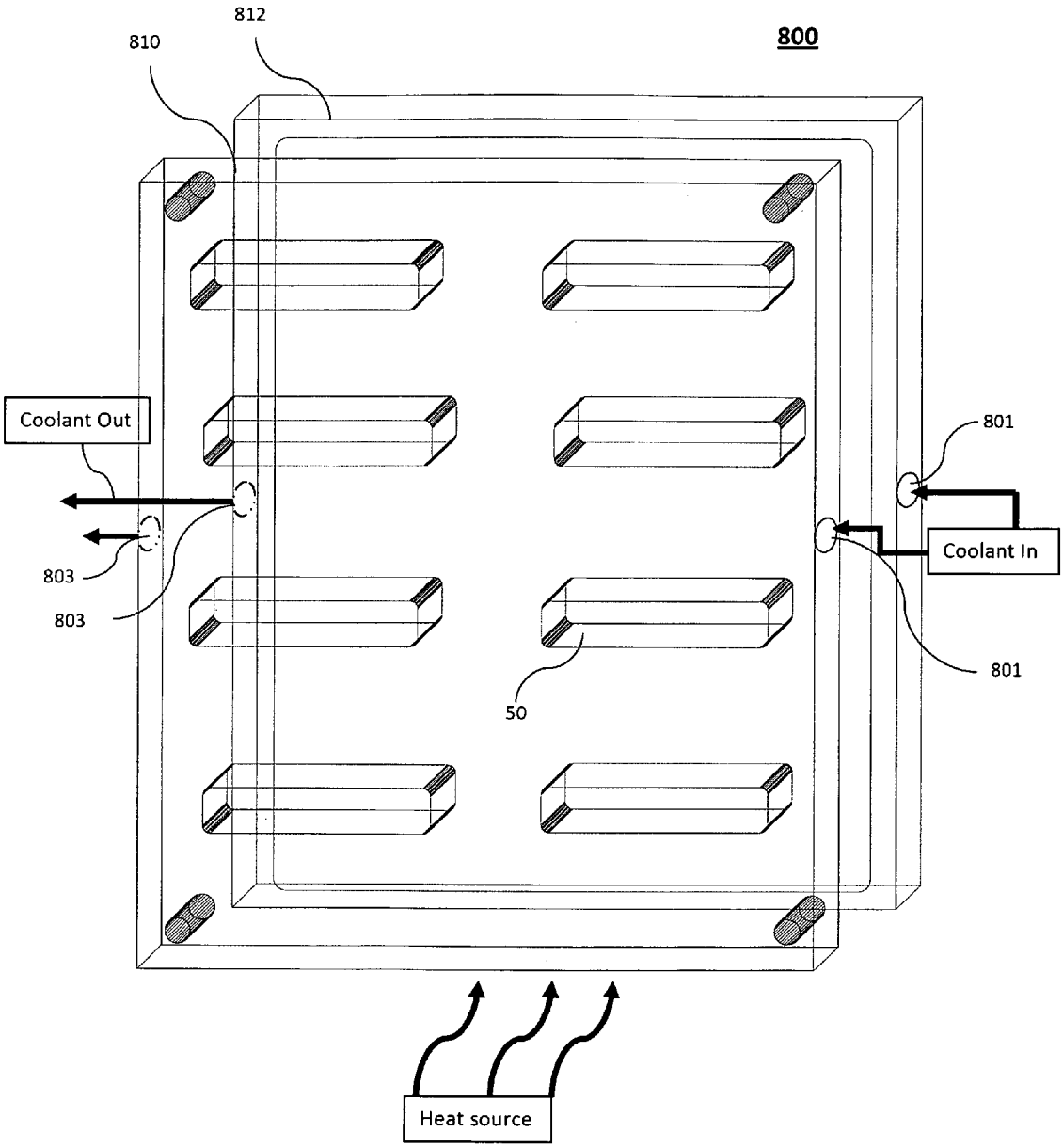
FIG. 8 is a simplified isometric drawing of an apparatus for enabling the holding of a sheet of metal and for the application of heat to multiple regions of the metal sheet for treating multiple regions of the metal sheet simultaneously.

The fixture of FIG. 7 allows for the annealing and embossing of one card at a time. Referring to FIG. 8, there is shown a fixture (jig) 800 which can be used to anneal multiple specific, selected, regions located on a sheet of metal at the same time. The fixture 800 can be used to anneal multiple regions of multiple cards of FIG. 8 illustrates that this can be done. The fixture 800 is shown to include two major plates 810, 812 between which a sheet of metal (not shown) can be nested. Windows (or cut outs 50), which may be of the same, or different shapes, are formed along one or both plates 810, 812. The plates 810, 812 function as template for the metal sheet nested between them and include means for maintaining the areas of the sheet of metal (outside regions 50) below the annealing temperature while heat is being applied thru the windows 50 to the metal sheet held securely within the fixture. As in FIG. 7 a coolant is supplied via apertures 801 and the warmed coolant is outputted at apertures 803. The outputted coolant can then be re-circulated via a refrigerator to the inputs 801. A sheet of metal may thus be treated to have a multiplicity of selected regions 50*a* which are ductile and relatively easy to emboss. The sheet may then be "diced" to produce a multiplicity of cards.

It has thus been shown that regions of a metal layer (or sheet) can be annealed at the same time and that the metal layer can then be embossed to form a "metal" card (with little additional processing). It has also been shown that regions of a metal layer (or sheet) can be annealed at the same time (or at different times) and that additional layers of material (preferably soft) can be added above (in back of) and below (in front of) the metal layer to form an assembly which can then be embossed to form a "metal" card. This assembly may also undergo some additional processing steps to impart desired characteristics to the "metal" card.

What is claimed is:

1. A method for forming a metalized card, comprising the steps of:

selecting a non-annealed metal layer suitable for use in forming a metallized card;

annealing a selected portion of the metal layer wherein the selected portion is less than the entire metalized card and rendering the metal within the selected portion ductile and susceptible to being embossed so as to reduce the power needed to emboss the selected portion of the metal layer and to reduce the wear and tear on the embossing equipment;

wherein annealing includes the steps of placing the metal layer within a fixture having a window region for enabling sufficient heat to be applied to the metal layer within the window region to only anneal soften the region of the metal layer within the window region;

heating the selected portion of the metal layer to above the recrystallization temperature and maintaining a suitable temperature, and then cooling;

controlling the heat of the non selected portions of the metal layer to prevent the non selected portions of the metal layer from being softened when heat is being applied to the selected portion;

embossing the selected portion of the metal layer with selected information; and processing said metal layer to form said metalized card.

2. A method as claimed in claim 1, wherein the heat applied to the selected portion is of a nature to fully anneal the selected portion.

3. A method as claimed in claim 2, wherein controlling the heat of the non selected portion of the metal layer includes applying a heat sink to cool the non selected portions of the metal layer.

4. A method as claimed in claim 2, wherein said metal layer has a surface area and wherein the heat sink is applied to cool the entire surface area of the metal layer except for the selected portion of the metal layer.

5. A method as claimed in claim 1 wherein the fixture includes means for cooling the portion of the metal layer outside of the window region and preventing the temperature of the metal layer outside the window region from rising above predetermined limits.

6. A method as claimed in claim 1, only the selected portion of the metal layer to be embossed has sufficient heat applied to it to anneal the selected portion and the regions of the metal layer which are not to be embossed are not subjected to such heat as would cause them to lose their stiffness.

7. A method as claimed in claim 1 wherein an additional layer of a soft material is added to the metal layer.

8. A method as claimed in claim 1 wherein at least one additional layer of a soft material is added to the metal layer after it has undergone the annealing process to form an assembly; and wherein the assembly is then embossed with desired information.

9. A method for embossing a metal layer used in forming a metalized card comprising the steps of:

selecting an un-annealed metal layer suitable for use in forming a metallized card;

placing the metal layer in a fixture for holding the metal layer, said fixture having a window region for enabling heat to be applied to selected portions of the metal layer within the window region;

annealing the selected portions of the metal layer and softening the metal within the selected portions so it can be embossed with reduced wear and tear on the embossing equipment; wherein annealing includes the steps of heating the selected portion of the metal layer to above the recrystallization temperature and maintaining a suitable temperature, and then cooling;

controlling the heat applied to a non selected portions of the metal layer being outside the window region to prevent the non selected portions of the card from being softened when heat is being applied to the selected portions; and embossing the selected portions of the metal layer with desired information.

10. A method as claimed in claim 9, wherein controlling the heat applied to non selected portions of the metal layer includes applying a heat sink to the non selected portions of the metal card.

11. A method as claimed in claim 10, wherein said metal layer has a surface area and wherein the heat sink cools the entire surface area of the metal layer except for the selected portions of the metal layer.

12. A method as claimed in claim 9, wherein the fixture includes means for cooling the portion of the metal layer outside of the window region and preventing the temperature of the metal layer outside the window region from rising above predetermined limits.

13. A method as claimed in claim 9, including using a fixture to ensure that only the selected portion of the metal layer to be embossed has heat applied to it and the regions of the metal layer which are not to be embossed are not subjected to the heat treatment, whereby these regions remain hard and stiff and not subjected to bending.

14. A method as claimed in claim 9, wherein the metal layer is part of a metal sheet.

* * * * *